US009057039B2

(12) United States Patent
Abraham

(10) Patent No.: US 9,057,039 B2
(45) Date of Patent: Jun. 16, 2015

(54) METHOD OF LUBRICATING A TRACTOR HYDRAULIC

(75) Inventor: William D. Abraham, Concord, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/054,623

(22) PCT Filed: Jul. 22, 2009

(86) PCT No.: PCT/US2009/051333

§ 371 (c)(1), (2), (4) Date: Feb. 17, 2011

(87) PCT Pub. No.: WO2010/011702

PCT Pub. Date: Jan. 28, 2010

(65) Prior Publication Data

US 2011/0294707 A1 Dec. 1, 2011

Related U.S. Application Data

(60) Provisional application No. 61/082,907, filed on Jul. 23, 2008.

(51) Int. Cl.

| | |
|---|---|
| ***C10M 135/36*** | (2006.01) |
| ***C10M 137/10*** | (2006.01) |
| ***C07F 9/02*** | (2006.01) |
| ***C10M 137/06*** | (2006.01) |
| ***C10M 137/08*** | (2006.01) |

(52) U.S. Cl.

CPC ..... *C10M 137/06* (2013.01); *C10M 137/08* (2013.01); *C10M 2219/044* (2013.01); *C10M 2219/046* (2013.01); *C10M 2219/106* (2013.01); *C10M 2223/042* (2013.01); *C10M 2223/043* (2013.01); *C10N 2230/12* (2013.01); *C10N 2230/24* (2013.01); *C10N 2230/40* (2013.01); *C10N 2230/43* (2013.01); *C10N 2240/04* (2013.01); *C10N 2240/08* (2013.01); *C10N 2260/12* (2013.01)

(58) Field of Classification Search

None

See application file for complete search history.

(56) References Cited

U.S. PATENT DOCUMENTS

| | | | | |
|---|---|---|---|---|
| 2,411,671 | A * | 11/1946 | Cantrell et al. | 508/423 |
| 4,136,043 | A | 1/1979 | Davis | |
| 5,843,873 | A * | 12/1998 | Butke et al. | 508/185 |
| 6,468,946 | B2 | 10/2002 | Vinci | |
| 2008/0182770 | A1 * | 7/2008 | Ramsey | 508/423 |
| 2009/0215657 | A1 * | 8/2009 | Ripple | 508/186 |

FOREIGN PATENT DOCUMENTS

| | | |
|---|---|---|
| WO | 2005021962 | 3/2005 |
| WO | 2007005423 | 1/2007 |
| WO | 2008014319 | 1/2008 |

OTHER PUBLICATIONS

Corresponding PCT Publication No. 2010/011702 A1 and Search Report published Jan. 28, 2010.

Written Opinion of corresponding PCT Application No. PCT/US2009/051333 dated Oct. 20, 2009.

* cited by examiner

*Primary Examiner* — Vishal Vasisth

(74) *Attorney, Agent, or Firm* — Michele M. Tyrpak; David M. Shold

(57) ABSTRACT

The present invention relates to a method of lubricating a tractor with a lubricating composition containing: an oil of lubricating viscosity and a sulphur-free phosphorus-containing salt of either (i) a hydroxy-substituted di-ester of phosphoric acid, or (ii) a phosphorylated hydroxy-substituted di- or tri-ester of phosphoric acid.

17 Claims, No Drawings

METHOD OF LUBRICATING A TRACTOR HYDRAULIC

This application is a 371 of PCT/US09/51333, filed Jul. 22, 2009 which claims benefit of 61/082,907, filed Jul. 23, 2008.

FIELD OF INVENTION

The present invention relates to a method of lubricating a tractor with a lubricating composition containing: an oil of lubricating viscosity and a sulphur-free phosphorus-containing compound of a salt of either (i) a hydroxy-substituted di-ester of phosphoric acid, or (ii) a phosphorylated hydroxy-substituted di- or tri-ester of phosphoric acid.

BACKGROUND OF THE INVENTION

Multi-application lubricants that are used to lubricate the moving parts of off-highway mobile equipment such as farm tractors, off-highway equipment, and construction equipment are designed to lubricate the transmissions, differentials, final-drive planetary gears, wet-brakes, and hydraulic systems of said equipment. Therefore these fluids must meet many performance requirements including water tolerance, copper corrosion resistance, wet-brake friction, wear resistance, and high energy clutch transmission performance. Lubricants such as tractor lubricants are often exposed to large contaminant amounts of water. The contaminant amounts of water are believed to be caused by ingress of water through equipment seals during operation. The water may form a second layer in the lubricant. Typically, to reduce the formation of the second layer, emulsifiers are employed. If the water is not emulsified into the lubricant, the water may cause additional difficulties such as copper corrosion from copper containing parts of a wet-brake, a transmission, a hydraulic, a final drive, a power take-off system. These parts are typically lubricated by a single lubricant supplied from a common sump.

European Patent Application 1 191 087 A discloses a method of protecting a copper-containing metal from loss of copper when in contact with a functional fluid composition containing water, said method comprising employing in said functional fluid an oil-soluble dimercaptothiadiazole compound or derivative thereof in an amount sufficient to protect against loss of copper. There is no disclosure of emulsifying water in the lubricant.

In addition, many lubricants contain zinc dialkyldithiophosphate (ZDDP) antiwear agents. In the presence of water, the ZDDP may break down, resulting in release of more labile (or reactive) sulphur. The labile sulphur may increase copper corrosion. Additionally, as the ZDDP antiwear agent decomposes increased wear may occur due to the presence of reduced amounts of antiwear agent.

SUMMARY OF THE INVENTION

The inventors of this invention have discovered that the method (and use) as disclosed herein is capable of providing at least one of a reduction (or prevention) of copper corrosion, reduction (or prevention) of wear, acceptable friction performance, reduction (or prevention) of sludge (or other deposits) and an increased level of water emulsibility. In one embodiment the method and use described herein provide a reduction (or prevention) of copper corrosion, and an increased level of water emulsibility. In one embodiment the method and use described herein provide a reduction (or prevention) of wear, and an increased level of water emulsibility. In one embodiment the method and use described herein provide a reduction (or prevention) of copper corrosion, a reduction (or prevention) of wear, and an increased level of water emulsibility.

In one embodiment the invention provides a method of lubricating at least one of a wet-brake, a transmission, a hydraulic, a final drive, a power take-off system, and combinations thereof, of a tractor, comprising supplying to the tractor a lubricating composition comprising: an oil of lubricating viscosity and a sulphur-free phosphorus-containing salt of either (i) a hydroxy-substituted di-ester of phosphoric acid, or (ii) a phosphorylated hydroxy-substituted di- or tri-ester of phosphoric acid or a mixture of (i) and (ii).

In one embodiment the invention provides a method of lubricating at least one of a wet-brake, a transmission, a hydraulic, a final drive, a power take-off system, and combinations thereof, of a tractor, comprising supplying to the tractor a lubricating composition comprising: an oil of lubricating viscosity and an amine salt of a sulphur-free phosphorus-containing compound which may be represented Formula (1) as is described herein below.

Typically a tractor wet-brake, transmission, hydraulic, final drive and power take-off system share a common oil sump.

In one embodiment the invention provides for the use of a sulphur-free phosphorus-containing compound of a salt of either (i) a hydroxy-substituted di-ester of phosphoric acid, or (ii) a phosphorylated hydroxy-substituted di- or tri-ester of phosphoric acid as a water emulsifying agent in a tractor lubricant capable of lubricating at least one of a wet-brake, a transmission, a hydraulic, a final drive, a power take-off system, and combinations thereof.

In one embodiment the invention provides for the use of an amine salt of a sulphur-free phosphorus-containing compound which may be represented Formula (1) as is described herein below as a water emulsifying agent in a tractor lubricant capable of lubricating at least one of a wet-brake, a transmission, a hydraulic, a final drive, a power take-off system, and combinations thereof.

In one embodiment the invention provides for the use of a sulphur-free phosphorus-containing salt of either (i) a hydroxy-substituted di-ester of phosphoric acid, or (ii) a phosphorylated hydroxy-substituted di- or tri-ester of phosphoric acid as is described herein below as a water emulsifying agent in a lubricant containing contaminant amounts of water (typically at least 0.05 wt %, or at least 0.1 wt %, or 0.05 wt % to 5 wt %, or 0.1 wt % to 2 wt %). Typically the lubricant is a tractor lubricant capable of lubricating at least one of a wet-brake, a transmission, a hydraulic, a final drive, a power take-off system, and combinations thereof.

In one embodiment the invention provides for the use of an amine salt of a sulphur-free phosphorus-containing compound which may be represented Formula (1) as is described herein below as a water emulsifying agent (in addition to antiwear and/or extreme pressure performance) in a lubricant containing contaminant amounts of water (typically at least 0.05 wt %, or at least 0.1 wt %, or 0.05 wt % to 5 wt %, or 0.1 wt % to 2 wt %). Typically the lubricant is a tractor lubricant capable of lubricating at least one of a wet-brake, a transmission, a hydraulic, a final drive, a power take-off system, and combinations thereof.

Typically the salt of either (i) a hydroxy-substituted di-ester of phosphoric acid, or (ii) a phosphorylated hydroxy-substituted di- or tri-ester of phosphoric acid as described above is (a) an amine salt, or (b) a mixed salt of an amine and a metal.

DETAILED DESCRIPTION OF THE INVENTION

The present invention provides a method for lubricating and a use as described above.

Salt of a Sulphur-Free Phosphorus-Containing Compound

In one embodiment an amine salt of a sulphur-free phosphorus-containing compound may be a salt of either (i) a hydroxy-substituted di-ester of phosphoric acid, or (ii) a phosphorylated hydroxy-substituted di- or tri-ester of phosphoric acid. The salt of either (i) a hydroxy-substituted di-ester of phosphoric acid, or (ii) a phosphorylated hydroxy-substituted di- or tri-ester of phosphoric acid may provide the lubricating composition with at least one of antiwear performance, emulsifying performance or copper corrosion performance. The amine salt of a sulphur-free phosphorus-containing compound may also be represented Formula (1):

Formula (1)

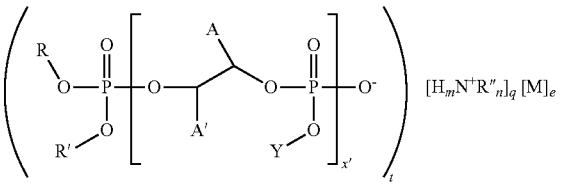

wherein

A and A' are independently H, or a hydrocarbyl group containing 1 to 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)-(such as RO(R'O)P(O)—$CH_2CH(CH_3)$—);

x' ranges from 0 to 1 (in one embodiment when x'=0, R' is a hydroxyalkyl group);

m and n are both positive non-zero integers, with the proviso that the sum of (m+n) is equal to 4;

M is a metal ion (i.e, an equivalent of a metal ion);

t is an integer varying from 1 to 4 (or 1 to 2); and q and e are numbers whose total provides complete valence to satisfy t, with the proviso that q is in the range of 0 to 2, (or 0.1 to 1.5 or 0.1 to 1), and e is in the range of 0 to 1, or 0 to 0.9.

The amine salt of a sulphur-free phosphorus-containing compound may be represented by Formula (1a):

Formula (1a)

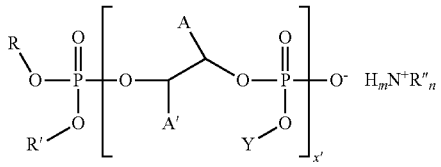

wherein

A and A' are independently H, or a hydrocarbyl group containing 1 to 30 carbon atoms;

each R and R" group are independently a hydrocarbyl group;

each R' is independently R, H, or a hydroxyalkyl group;

Y is independently R', or a group represented by RO(R'O)P(O)—CH(A')CH(A)-(such as RO(R'O)P(O)—$CH_2CH(CH_3)$—);

x' ranges from 0 to 5, or 0 to 1 (in one embodiment when x'=0, R' is a hydroxyalkyl group);

m and n are both positive non-zero integers, with the proviso that the sum of (m+n) is equal to 4.

In one embodiment the compound represented by Formula (1) or Formula (1a) has x' equal to 1.

In one embodiment the compound represented by Formula (1) or Formula (1a) has x' is equal to 0.

In one embodiment the compound represented by Formula (1) or Formula (1a) has m equal to 2 and n equal to 2.

In one embodiment the compound represented by Formula (1) or Formula (1a) has m equal to 3 and n equal to 1.

In one embodiment A and A' independently contain 1 to 10, or 2 to 6, or 2 to 4 carbon atoms.

In one embodiment R, R' and R" all independently contain 1 to 30, or 1 to 20, or 4 to 20 carbon atoms. In one embodiment up to half of the R' groups may be hydrogen.

In one embodiment R" contains 8 to 26, or 10 to 20, or 13 to 19 carbon atoms.

In one embodiment when x' is equal to 0, the compound of Formula (1) or Formula (1a) may be an amine phosphate as disclosed in U.S. Pat. No. 6,468,946. The amine phosphate disclosed therein may be a mono- or di-hydrocarbyl-substituted ester of a phosphorus compound salted with an amine. Each hydrocarbyl-substituted ester group may contain 4 to 40 or 6 to 20 carbon atoms.

The compound of Formula (1) or Formula (1a) includes amine salts of a primary amine, a secondary amine, a tertiary amine, or mixtures thereof. In one embodiment the primary amine includes a tertiary-aliphatic primary amine.

Examples of suitable primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen® C, Armeen® 0, Armeen® OL, Armeen® T, Armeen® HT, Armeen® S and Armeen® SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, bis-2-ethylhexylamine, N-methyl-1-amino-cyclohexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyloleylamine (Armeen® DMOD).

In one embodiment the amines may be in the form of a mixture. Examples of suitable mixtures of amines include (i) an amine with 11 to 14 carbon atoms on tertiary alkyl primary groups, (ii) an amine with 14 to 18 carbon atoms on tertiary alkyl primary groups, or (iii) an amine with 18 to 22 carbon atoms on tertiary alkyl primary groups. Other examples of tertiary alkyl primary amines include tert-butylamine, tert-hexylamine, tert-octylamine (such as 1,1-dimethylhexylamine), tert-decylamine (such as 1,1-dimethyloctylamine), tertdodecylamine, tert-tetradecylamine, tert-hexadecylamine, tert-octadecylamine, tert-tetracosanylamine, and tert-octacosanylamine.

In one embodiment a useful mixture of amines includes "Primene® 81R" or "Primene® JMT." Primene® 81R and Primene® JMT (both produced and sold by Rohm & Haas) may be mixtures of C11 to C14 tertiary alkyl primary amines and C18 to C22 tertiary alkyl primary amines respectively.

In one embodiment the metal ion of Formula (1) may be a mono- or di-valent metal, or mixtures thereof. In one embodiment the metal ion may be divalent.

In one embodiment the metal of the metal ion includes lithium, sodium, potassium, calcium, magnesium, barium, copper, nickel, tin or zinc.

In one embodiment the metal of the metal ion includes lithium, sodium, calcium, magnesium, or zinc. In one embodiment the metal of the metal ion may be zinc.

In one embodiment t is equal to 1, when the compound of Formula (1) is an amine salt or a metal salt of a monovalent metal.

In one embodiment t is equal to 2, when the compound of Formula (1) is a metal salt of a divalent metal.

In one embodiment q is in the range of 0.5 to 1; and e is in the range of 0 to 0.5.

In one embodiment the compound of Formula (1) is free of a metal ion (e is equal to zero; and q is equal to one). In one embodiment t is equal to 1, e is equal to 0, and q is equal to 1.

Processes to Prepare Compound of Formula (1) and Formula (1a)

In one embodiment the sulphur-free amine salt of a phosphorus-containing compound is obtained/obtainable by a process comprising: reacting an amine with either (i) a hydroxy-substituted di-ester of phosphoric acid, or (ii) a phosphorylated hydroxy-substituted di- or tri-ester of phosphoric acid.

In one embodiment the sulphur-free amine salt of a phosphorus-containing compound is obtained/obtainable by a process comprising: reacting an amine with either (i) a hydroxy-substituted di-ester of phosphoric acid, or (ii) a phosphorylated hydroxy-substituted di- or tri-ester of phosphoric acid.

In one embodiment the salt of a hydroxy-substituted di-ester of phosphoric acid may be prepared by a process comprising:

(i) reacting a phosphating agent (such as $P_2O_5$, $P_4O_{10}$, or equivalents thereof) with an alcohol, to form a mono- and/or di-phosphate ester;

(ii) reacting the phosphate ester with an alkylene oxide, to form a hydroxy-substituted di- or tri-ester of phosphoric acid; and (iii) salting the hydroxy-substituted di-ester of phosphoric acid is reacted with an amine and/or metal.

In one embodiment the hydroxy-substituted di-ester of phosphoric acid of (ii) may be further reacted at least once more, by repeating step (i) above, with additional phosphating agent as set forth above, typically forming a phosphorylated hydroxy-substituted di- or tri-ester of phosphoric acid, before salting with an amine and/or metal (as in step (iii) above).

In different embodiments, steps (i) and (ii) may be repeated at least once more, optionally followed by step (i) before salting with an amine and/or metal (as in step (iii) above). For example the salts may be prepared by a process comprising performing the steps (i), (ii), and (iii); or (i), (ii), (i), and (iii); or (i), (ii), (i), (ii), and (iii); (i), (ii), (i), (ii), (i), and (iii), or (i), (ii), (i), (ii), (i), (ii), and (iii), or (i), (ii), (i), (ii), (i), (ii), (i) and (iii), or (i), (ii), (i), (ii), (i), (ii), (i), (ii) and (iii), as defined above.

In different embodiments the reaction product yields 1 wt % to 99 wt %, or 20 wt % to 80 wt %, or 35 wt % to 75 wt %, of the sulphur-free amine salt of a phosphorus-containing compound of the invention.

In different embodiments, the mole ratio in step (i) of the mono-phosphate to di-phosphate includes ranges of 1:10 to 10:1, or 1:5 to 5:1, or 1:2 to 2:1, or 1:1.

In different embodiments, the mole ratio (based on the amount of phosphorus) in step (i) of alkylene oxide to the mono- and/or di-phosphate ester of step (i) includes ranges of 0.6:1 to 1.5:1, or 0.8:1 to 1.2:1, including 1:1.

In one embodiment the alkylene oxide includes ethylene oxide, propylene oxide or butylene oxide; the mole ratio of alkylene oxide to hydroxy-substituted di-ester of phosphoric acid in step (ii) includes 1:1.

In one embodiment the alkylene oxide includes $C_5$ and higher alkylene oxides and the mole ratio of alkylene oxide to the hydroxy-substituted di-ester of phosphoric acid in step (ii) includes broader ranges because the alkylene oxides are less volatile under reaction conditions.

The process described above in steps (i) to (iii), in different embodiments may be carried out at a reaction temperature in a range of 30° C. to 140° C., or 40° C. to 110° C., or 45° C. to 90° C.

The process may be carried out at reduced pressure, atmospheric pressure or above atmospheric pressure. In one embodiment the process may be carried out at atmospheric pressure or above atmospheric pressure.

In one embodiment the process may be carried out in an inert atmosphere. Examples of a suitable inert atmosphere include nitrogen, argon, or mixtures thereof.

In different embodiments, the alkylene oxide contains 2 to 10, or 2 to 6, or 2 to 4 carbon atoms. In one embodiment the alkylene oxide includes ethylene oxide, propylene oxide, butylene oxide, or mixtures thereof. In one embodiment the alkylene oxide includes propylene oxide.

In different embodiments, the alcohol contains 1 to 30, or 4 to 24, or 8 to 18 carbon atoms. The alcohol may be linear or branched. The alcohol may be saturated or unsaturated.

Examples of a suitable alcohol include hexanol, heptanol, octanol, nonanol, dodecanol, dodecanol, tridecanol, tetradecanol, pentadecanol, hexadecanol, heptadecanol, octadecanol, octadecenol (oleyl alcohol), nonadecanol, eicosyl-alcohol, or mixtures thereof. Examples of a suitable alcohol include for example, 4-methyl-2-pentanol, 2-ethylhexanol, isooctanol, or mixtures thereof.

Examples of commercially available alcohols include Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

Useful amines for salting include a primary amine, a secondary amine, a tertiary amine, or mixtures thereof. A more detailed description of useful amines is defined above.

Amine Salt of Phosphoric Acid

Preparative Examples

Preparative Example 1

Step A: Phosphorus pentoxide (219 g, 1.54 mol) is added slowly over a period of 1.5 hours to a flask containing isooctyl alcohol (602 g, 4.63 mol) whilst stirring at 60° C. to 70° C. in a nitrogen atmosphere. The mixture is then heated to 90° C. and held there for 5 hours. The product is cooled. Analysis of the product indicates a phosphorus content of 11.6 wt %.

Step B: At temperature of 50° C., a flask containing the product of Step A (760 g, 2.71 mol based on equivalent weight of 280 g/mol) stirring at (15-40° C.) mixed with a stoichiometric amount of propylene oxide (157.7 g, 2.71 mol) dropwise via an addition funnel. The propylene oxide is added over a period of 1.5 hours, to form a mixture. The mixture is then heated to 70° C. and held for 2 hours. The product is cooled. The product of Step B has a phosphorus content of 9.6 wt %.

Step C: The product of Step B (881.5 g, 2.73 mol P based on % P=9.6) is heated to 50° C. under nitrogen and phosphorus pentoxide (129 g, 0.91 mol) is added in four equal portions over one hour. During the addition the temperature is maintained between the range of 55° C. to 70° C., whilst vigorously stirring to provide a product that is a homogeneous solid. The temperature is raised to 80° C. and held for 3 hours, to form a product. Upon cooling the product contains 13.7 wt % of phosphorus Step D: The product of Step C (706.7 g, 2.24 mol) is heated to 45° C. in a nitrogen atmosphere in a flask. Bis-(2-ethylhexyl)amine (596 g, 2.47 mol) is added dropwise via an addition funnel over a period of 2 hours whilst controlling the temperature to be 55° C. to 60° C. The flask is then heated to 75° C. and held there for 2 hours. Upon cooling the product of Step D is light orange and has a phosphorus content of 7.7 wt %.

Preparative Example 2

Preparative Example 2 is prepared employing a similar procedure as Step A and Step B of Preparative Example 1. However, for Step A, a stoichiometric amount of propylene oxide (209 g, 3.60 mol) is added to isooctyl phosphate acid (952 g, 3.43 mol). The mixture is then heated to 75° C. for 4 hours. The resultant product of Step A has a phosphorus content of 9.65 wt %. For Step B, the product of Step A (208 g, 0.374 mol) is heated in the flask and bis-(2-ethylhexyl) amine (97.5 g, 0.404 mol) is added dropwise via an addition funnel over a period of 40 minutes. The reaction temperature is then raised to 75° C. and held for 5 hours. The resultant product has a phosphorus content of 6.6 wt %.

Preparative Example 3

Preparative Example 3 is prepared in a similar procedure as Preparative Example 1. However, step A of Preparative Example 3 reacts phosphorus pentoxide (189 g, 1.33 mol) with methylamyl alcohol (408 g, 4 mol). The phosphorus pentoxide is added over a period of 75 minutes and at a temperature of 60° C. The product is then heated to 70° C. and held for 1.5 hours. The resultant product has a phosphorus content of 13.7 wt %. Step B is carried out by reacting the product of Step A (171.7 g, 0.719 mol based on equivalent weight of 240 g/mol), with 1.1 equivalents of propylene oxide (46.0 g, 0.791 mol). The resultant product has a phosphorus content of 10.96 wt %. Step C is carried out by heating the product of Step B (200 g, 0.71 mol) at 60° C. under a nitrogen atmosphere and reacting with phosphorus pentoxide (33 g, 0.23 mol). The reaction exotherm reaches 87° C. Upon cooling to 65° C., the flask is held at this temperature for 1.5 hours. The flask is then cooled to 40° C. followed by the dropwise addition over a period of 1.5 hours of bis-(2-ethylhexyl) amine (200 g, 0.83 mol). The flask is then heated to 75° C. and held for 2 hours. The product has a phosphorus content of 8.6 wt %, and a nitrogen content of 2.8 wt %.

Preparative Example 4

The process to prepare Preparative Example 4 is similar to that of Preparative Example 2. However, for Step A, the flask contains methylamyl phosphate acid (154.4 g, 0.647 mol) and at 25° C., under a nitrogen atmosphere, 1,2-epoxyhexadecane (163.0 g, 0.679 mol) is added dropwise via an addition funnel over a period of 1.5 hours. The mixture is then heated to 75° C. and held there for 4 hours. The product has a phosphorus content of 6.7 wt %. The product of Step A is then heated to 60° C., under a nitrogen atmosphere and phosphorus pentoxide (33 g, 0.23 mol) is added in two portions over a period of 1.5 hours. The temperature was held at 75° C. for 1.5 hours. The product is then heated to 40° C. under nitrogen and bis-(2-ethylhexyl)amine (144.8 g, 0.596 mol) was added dropwise via addition funnel over 1.5 hours. The temperature is then increased to 70° C. and held for a period of 2 hours. The product has a phosphorus content of 6.6 wt %, and a nitrogen content of 2.1 wt %.

Thiadiazole Compound

In one embodiment the lubricating composition disclosed herein further comprises a thiadiazole compound or derivatives thereof. Compounds of this type may be delivered as a dimercaptothiadiazole or as part of a multi-functional dispersant.

In one embodiment the thiadiazole compound is a multi-functional dispersant. Examples of suitable multi-functional dispersants include those disclosed in U.S. Pat. Nos. 4,136,043 and 6,251,840; and International Publications WO 2005/021692, WO2006/091371 and WO 2008/014319.

In one embodiment the multi-functional dispersant is described in U.S. Pat. No. 4,136,043. The multi-functional dispersant of this type may be produced by preparing a mixture of an oil-soluble dispersant and a dimercaptothiadiazole and heating the mixture above 100° C.

In one embodiment the multi-functional dispersant is described in WO 2008/014319. The multi-functional dispersant of this type may be prepared by heating together:

(i) a first dispersant substrate;
(ii) a thiadiazole compound, such as a dimercaptothiadiazole or oligomers thereof;
(iii) a borating agent; and
(iv) optionally a terephthalating agent; and
(v) optionally a phosphorus acid compound, said heating being sufficient to provide a product of (i), (ii), (iii) and optionally (iv) and optionally (v), which is soluble in an oil of lubricating viscosity.

In one embodiment the multi-functional dispersant is described in WO 2005/021692. The multi-functional dispersant is prepared by heating together: (a) a dispersant and (b) 2,5-dimercapto-1,3,4-thiadiazole or a hydrocarbyl-substituted 2,5-dimercapto-1,3,4-thiadiazole which is substantially insoluble in a hydrocarbon oil of lubricating viscosity at 25° C., and further either (c) a borating agent, (d) an inorganic phosphorus compound, or (e) a terephthalating agent, or mixtures of (c), (d), and (e), said heating being sufficient to provide a reaction product which is soluble in said hydrocarbon oil at 25° C.

The terephthalating agent may be an aromatic dicarboxylic acid or reactive equivalent thereof (halide, anhydride, ester) including a 1,3 dicarboxylic acid (e.g., isophthalic acid), a 1,4 dicarboxylic acid (terephthalic acid), or mixtures thereof.

In one embodiment the thiadiazole compound is a mercaptothiadiazole.

Examples of a thiadiazole include 2,5-dimercapto-1,3,4-thiadiazole, or oligomers thereof, a hydrocarbyl-substituted 2,5-dimercapto-1,3-4-thiadiazole, a hydrocarbylthio-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-dimercapto-1,3,4-thiadiazole or a hydrocarbyl-substituted 2,5-dimercapto-1,3-4-thiadiazole or a hydrocarbylthio-substituted 2,5-dimercapto-1,3,4-thiadiazole may be commonly utilised, with 2,5-dimercapto-[1,3,4]-thiadiazole most commonly utilised due to availability. In different embodiments the number of carbon atoms on the hydrocarbyl-substituent group includes 1 to 30, 2 to 25, 4 to 20, 6 to 16, or 8 to 10.

In one embodiment, the thiadiazole compound may be the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis(alkyldithio)-[1,3,4]-thiadiazoles, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thiadiazole, or 2,5-bis(tert-decyldithio)-1,3,4-thiadiazole.

In one embodiment the thiadiazole compound is delivered as a mixture of a dimercaptothiadiazole, and a multi-functional dispersant.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (typically hydrogenated) (e.g., polybutylenes, polypropylenes, propylene isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Prolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines.

The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the ashless antiwear agent, the amine-containing friction modifier and the other performance additives.

The lubricating composition may be in the form of a concentrate and/or a fully formulated lubricant. If the lubricating composition of the invention (comprising the additives disclosed herein above is in the form of a concentrate (which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally comprises other performance additives. These performance additives are well known to a skilled person.

Detergents include metallic detergents, such as salicylates, sulphonates, salixarates, phenates, or mixtures thereof. Typically the metal is calcium or magnesium or sodium. In one embodiment the metal is calcium. In one embodiment the detergent is a sulphonate, typically a calcium sulphonate detergent. When present, the detergent may be neutral, overbased, or mixtures thereof.

When present the detergent may be present in a sufficient amount to deliver 0.005 wt % to 0.40% of metal (or sufficient to provide a TBN of 0.10 to 10.0 mg/KOH) to the lubricating composition. In other embodiments the detergent may be present in sufficient amounts to provide 1200 ppm or less, or 1000 ppm or less, or 850 ppm or less of metal. The amount of metal delivered by the detergent may deliver 100 ppm to 1100 ppm, or 300 to 950 ppm of metal to the lubricating composition.

The detergent may also be present in an amount to provide TBN of 0.15 to 5.0, or 0.40 to 4.0.

Viscosity modifiers include hydrogenated copolymers of styrene-butadiene, ethylene-propylene copolymers, esterified copolymers of maleic anhydride and styrene, esterified copolymers of maleic anhydride and olefins (typically 1-$C_{8-20}$-alkenes), styrene-isoprene copolymers, hydrated styrene-isoprene copolymers, polyisobutylene, or mixtures thereof). The viscosity modifiers may also be further grafted with an unsaturated dicarboxylic acid anhydride or derivatives thereof and an amine to form a dispersant viscosity modifier (often referred to as DVM), thus named, because they also exhibit dispersant properties. Other viscosity modifiers include polyacrylates, polymethacrylates, and amine containing derivatives thereof (dispersant viscosity modifiers).

Foam inhibitors include silicones, polyacrylates, or mixtures thereof. Various antifoam agents are described in Foam Control Agents by H. T. Kerner (Noyes Data Corporation, 1976, pages 125-176). Mixtures of silicone-type antifoam agents such as the liquid dialkyl silicones with various other substances are also effective. Examples of a mixture includes silicones mixed with an acrylate polymer, or silicones mixed with one or more amines, or silicones mixed with one or more amine carboxylates.

Friction modifiers include fatty alkyl phosphite esters (such alkyl groups may contain 4 to 40, or 12 to 20 carbon atoms), fatty amines (such as oleyl amine), glycerol esters such as glycerol monooleate, borated glycerol esters, fatty acid amides, non-borated fatty epoxides, borated fatty epoxides, borated phospholipids, alkoxylated fatty amines, borated alkoxylated fatty amines, metal salts of fatty acids, fatty imidazolines, metal salts of alkyl salicylates, condensation products of carboxylic acids or polyalkylene-polyamines, or amides of hydroxyalkyl compounds. A more detailed description of suitable friction modifiers is described in paragraphs [0089] to [0105] of International Application WO 08/014,319.

Dispersants include polyisobutylene succinimides, polyisobutylene esters, polyisobutylene mixed ester-amide compounds, Mannich bases, or mixtures thereof. In one embodiment of the invention the dispersant is a polyisobutylene succinimide derived from a polyisobutylene with number average molecular weight in the range 350 to 5000, or 500 to 3000. Succinimide dispersants and their preparation are disclosed, for instance in U.S. Pat. No. 4,234,435.

The dispersants may also be post-treated by conventional methods by a reaction with any of a variety of agents. Among these are urea, thiourea, dimercaptothiadiazoles, carbon disulphide, aldehydes, ketones, carboxylic acids, hydrocarbon-substituted succinic anhydrides, maleic anhydride, nitriles, epoxides, boron compounds, and phosphorus compounds.

Antiwear agents include non-ionic phosphorus compounds (such as alkyl or dialkyl phosphites); amine salts of phosphorus compounds; ammonium salts of phosphorus compounds; metal salts of phosphorus compounds, such as metal dialkyldithiophosphates and metal dialkylphosphates, amine salts of phosphorylated hydroxy-substituted triesters of phosphorothioic acid, borates, hydroxycarboxylic acids, hydroxy polycarboxylic acid esters (such as citrates or tartrates), sulphurised olefins, or mixtures thereof.

A more detailed description of the antiwear agents including non-ionic phosphorus compounds, amine salts of phosphorus compounds, ammoniums salt of phosphorus compounds and metal salts of phosphorus compounds such as a metal dialkyldithiophosphates and metal dialkylphosphates is provided in paragraphs [0065] to [0086] of International Application WO 08/014,319.

In one embodiment the metal dialkyldithiophosphate is a zinc dialkyldithiophosphate.

In one embodiment the lubricating composition disclosed herein contains no zinc dialkyldithiophosphate.

Amine salts of phosphorylated hydroxy-substituted triesters of phosphorothioic acids are described in U.S. Pat. No. 3,197,405.

In one embodiment the antiwear agent is a mixture of non-ionic phosphorus compounds and amine salts of phosphorylated hydroxy-substituted triesters of phosphorothioic acids as described in U.S. Pat. No. 3,197,405.

When present the antiwear agent may be in the lubricant at 0.01 wt % to 0.25 wt % of phosphorus, or 0.03 wt % to 0.2 wt % of phosphorus, or 0.05 wt % to 0.15 wt % of phosphorus.

In certain embodiments the lubricant disclosed above may contain one or more of corrosion inhibitors, dispersant viscosity modifiers, extreme pressure agents, antioxidants (including alkylated diphenylamines (typically di-nonyl diphenylamine, octyl diphenylamine, di-octyl diphenylamine), hindered phenols, oil-soluble molybdenum compounds, sulphurised olefins, sulphides, or mixtures thereof), demulsifiers, emulsifiers (such as polyisobutylene succinic acids) pour point depressants, seal swelling agents and mixtures thereof.

In one embodiment a hindered phenol antioxidant is an ester and may include, e.g., Irganox™ L-135 from Ciba or an addition product derived from 2,6-di-tert-butylphenol and an alkyl acrylate, wherein the alkyl group may contain 1 to 18, or 2 to 12, or 2 to 8, or 2 to 6, or 4 carbon atoms. A more detailed description of suitable ester-containing hindered phenol antioxidant chemistry is found in U.S. Pat. No. 6,559,105.

In one embodiment the lubricating composition further includes a water tolerance agent. The water tolerance agent may also be defined as a surfactant. Suitable surfactants include those disclosed in *McCutcheon's Emulsifiers and Detergents,* 1993, North American & International Edition. Examples of suitable surfactants include polyesters polyisobutylene succinic anhydrides (including hydrolysed succinic anhydrides, esters or diacids), sulphonic acids, alkanolamides, alkylarylsulphonates, amine oxides, poly (oxyalkylene) compounds, including block copolymers comprising alkylene oxide repeat units (e.g., Pluronic™), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, phenates, lecithin and derivatives, lignin and derivatives, monoglycerides and derivatives, olefin sulphonates, phosphate esters and derivatives, propoxylated and ethoxylated fatty acids or alcohols or alkyl phenols, sorbitan derivatives, sucrose esters and derivatives, sulphates or alcohols or ethoxylated alcohols or fatty esters.

In one embodiment the surfactant includes polyisobutylene succinic anhydride derivatives as taught in U.S. Pat. No. 4,708,753, and U.S. Pat. No. 4,234,435.

In one embodiment the surfactant includes polyesters as defined in column 2, line 44 to column 3, line 39 of U.S. Pat. No. 3,778,287. Examples of suitable polyester surfactants are prepared in U.S. Pat. No. 3,778,287 as disclosed in Polyester Examples A to F (including salts thereof).

In one embodiment the lubricating composition further includes at least one of a friction modifier, an antioxidant, an overbased detergent, a succinimide dispersant, an antiwear agent (other than those described herein as part of the invention), or mixtures thereof.

In one embodiment the lubricant further includes:

A. 0.1 to 6 weight percent detergent;

B. 0.1 to 3 weight percent antiwear agent;

C. 0.1 to 3 weight percent friction modifier;

D. 0 to 2 weight percent seal swell agent;

E. 50 to 700 ppm foam inhibitor;

F. 0 to 10 weight percent viscosity modifier; and

G. an oil of lubricating viscosity.

The following examples provide illustrations of the invention. These examples are non-exhaustive and are not intended to limit the scope of the invention.

EXAMPLES

Example 1 (EX1) is a tractor lubricant containing 0.1 wt % of a sulphur-free phosphorus-containing compound (and defined as a "S free P compound" in the table below) as disclosed herein (see any Preparative Examples 1 to 4 above). In addition, EX1 contains the additives summarised in the Table below. The amine phosphate defined in the table is an amine salt of phosphorylated hydroxyl-substituted triester of phosphorothioic acid as described in U.S. Pat. No. 3,197,405.

Example 2 (EX2) is a tractor lubricant containing is a tractor lubricant containing 0.13 wt % of a sulphur-free phosphorus-containing compound as disclosed herein (see any Preparative Examples 1 to 4 above). In addition, EX2 contains the additives summarised in the Table below. The amine phosphate defined in the table is an amine salt of phosphorylated hydroxyl-substituted triester of phosphorothioic acid as described in U.S. Pat. No. 3,197,405.

Comparative Example 1 (CE1) is similar to Example 1, except the sulphur-free phosphorus-containing compound is removed.

Comparative Example 2 (CE2) is similar to Example 1, except the sulphur-free phosphorus-containing compound is replaced with 0.1% amine salt of phosphorylated hydroxy-substituted triesters of phosphorothioic acids described in U.S. Pat. No. 3,197,405.

| | Tractor Lubricants | | | |
|---|---|---|---|---|
| | EX1 | CE1 | EX2 | CE2 |
| S free P compound | 0.1 | | 0.13 | |
| Amine phosphate | 0.6 | 0.6 | 0.6 | 0.7 |
| Friction modifiers | 0.85 | 0.85 | 0.94 | 0.85 |
| Dispersants | 0.68 | 1.25 | 1.3 | 1.25 |
| Emulsifiers | 0.2 | 0.2 | 0.17 | 0.2 |
| Compatibilzers | 0.1 | 0.1 | 0.07 | 0.1 |
| Antioxidant | 0.36 | 0.36 | 0.36 | 0.36 |
| Thiadiazole derivative | 0.21 | 0.21 | 0.24 | 0.21 |
| Antiwear agent | 0.6 | 0.6 | 0.61 | 0.6 |
| Detergent | 0.29 | 0.29 | 0.35 | 0.29 |
| Foam inhibitor | 0.0023 | 0.0023 | 0.0022 | 0.0023 |
| Viscosity modifier | 1.23 | 1.23 | 1.23 | 1.23 |
| Pour point depressant | 0.1 | 0.1 | 0.1 | 0.1 |

Footnote:

All additives are presented in amounts based on an oil-free basis i.e., the amounts shown are based on the active amounts of each additive. All amounts are presented as weight percent of the tractor lubricant.

Corrosion Test 1: Copper corrosion tests are carried out on tractor lubricants EX1, CE1 and CE2. The test methodology is the same as ASTM D130 at 150° C. for 3 hours.

Corrosion Test 2: The ZF copper corrosion test involves heating a copper coupon in a DKA test tube for 168 hours at 150° C. while air is purged through the sample.

Water Tolerance Test 1: A water tolerance test is carried out on tractor lubricants EX1, CE1 and CE2. The test methodology is the same as is disclosed in John Deere specification JDQ19 in which 200 mL of sample are blended for one minute with 0.8 mL of distilled water. The sample is stored for 7 days, then measurements are taken before and after centrifuge.

Water Tolerance Test 2: International Harvest water tolerance test IH BT7 involves blending 100 mL of sample with 2 mL distilled water in a paint shaker. The sample is stored for 7 days then measurements are taken.

The results obtained are as follows:

| | | Lubricants | | | |
|---|---|---|---|---|---|
| | | EX1 | CE1 | EX2 | CE2 |
| ASTM D130 | Cu rating | 1B | 1A | 1A | 1A |
| ZF Cu | Cu Rating | 4A | 4A | 4A | 4A |
| corrosion | Cu (ppm) | 46 | 267 | 103 | 78 |
| JDQ19 Before | Free Water % | 0 | 0.15 | 0 | 0.2 |
| Centrifuge | Emulsion % | 0 | 0 | 0 | 0 |
| JDQ19 After | Free Water % | 0.01 | 0.2 | 0.05 | 0.3 |
| Centrifuge | Emulsion % | 0 | 0 | 0 | 0 |
| IH BT7 Water | Amount emulsion | 0.02 | 6 | 0 | 4.2 |
| Tolerance | Amount water | 0.01 | 0 | 0.05 | 0 |

Overall the results indicate that the lubricating compositions exemplified by EX1 and EX2 provide improved corrosion inhibition and water tolerance compared to CE1 and CE2.

In addition to the above tests fluids also exhibit antiwear and friction performance as can be measured with the JDQ95 Spiral Bevel Wear test, the FZG wear test, and JDQ96 Wet-brake test.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented inclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms, and encompass substituents as pyridyl, furyl, thienyl and imidazolyl; and (iv) heteroatoms, including sulphur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating at least one of a wet-brake, a transmission, a hydraulic, a final drive, a power take-off system, and combinations thereof, of a tractor comprising supplying to the tractor a lubricating composition comprising: an oil of lubricating viscosity and a water emulsifying agent comprising a sulphur-free phosphorus-containing salt of either (i) a hydroxy-substituted di-ester of phosphoric acid, or (ii) a phosphorylated hydroxy-substituted di- or tri-ester of phosphoric acid, or a mixture of (i) and (ii), wherein sulphur-free phosphorus-containing salt is represented by Formula (1a):

Formula (1a)

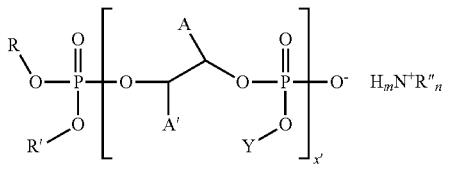

wherein

A and A' are independently H, or a hydrocarbyl group containing 1 to 30 carbon atoms, wherein at least one of A and A' is a hydrocarbyl group;

each R and R" group are independently a hydrocarbyl group;

each R' is independently R, H, or a hydroxyalkyl group;

Y is independently R', or a group represented by RO(R'O)P(O)—CH(A')CH(A)- (such as RO(R'O)P(O)—$CH_2CH(CH_3)$—);

x' ranges from 1 to 5;

m and n are both positive non-zero integers, with the proviso that the sum of (m+n) is equal to 4;

wherein the water emulsifying agent is added to the lubricant composition in an amount from 0.01 wt % to 0.25 wt % phosphorous.

2. The method of claim 1, wherein the lubricating composition further comprises:

A. 0.1 to 6 weight percent detergent;

B. 0.1 to 3 weight percent antiwear agent;

C. 0.1 to 3 weight percent friction modifier;

D. 0 to 2 weight percent seal swell agent;

E. 50 to 700 ppm foam inhibitor;

F. 0 to 10 weight percent viscosity modifier; and

G. an oil of lubricating viscosity.

3. The method of claim 1, wherein the oil of lubricating viscosity contains contaminant amounts of water present at 0.05 wt % to 5 wt % of the lubricating composition.

4. The method of claim 1 further comprising a thiadiazole compound or a derivative thereof.

5. The method of claim 4, wherein the thiadiazole compound is a mercaptothiadiazole.

6. The method of claim 4, wherein the thiadiazole compound is selected from the group consisting of 2,5-bis(tert-octyldithio)-1,3,4-thiadiazole, 2,5-bis(tert-nonyldithio)-1,3,4-thiadiazole, and 2,5-bis(tert-decyldithio)-1,3,4-thiadiazole.

7. The method of claim 4, wherein the thiadiazole compound is dimercaptothiadiazole, a thiadiazole incorporated as part of a multi-functional dispersant, or mixtures thereof.

8. The method of claim 7, wherein the multi-functional dispersant is produced by preparing a mixture of an oil-soluble dispersant and a dimercaptothiadiazole and heating the mixture above 100° C.

9. The method of claim 7, wherein the multi-functional dispersant is prepared by heating together:

(i) a first dispersant substrate;

(ii) a thiadiazole compound;

(iii) a borating agent; and (iv) optionally a terephthalating agent.

10. The method of claim 7, wherein the multi-functional dispersant is prepared by heating together: (a) a dispersant and (b) 2,5-dimercapto-1,3,4-thiadiazole or a hydrocarbyl-substituted 2,5-dimercapto-1,3,4-thiadiazole which is substantially insoluble in a hydrocarbon oil of lubricating viscosity at 25° C., and further either (c) a borating agent, (d) an inorganic phosphorus compound, or (e) a terephthalating agent, or mixtures of (c), (d), and (e), said heating being sufficient to provide a reaction product which is soluble in said hydrocarbon oil at 25° C.

11. The method of claim 1 further comprising a detergent.

12. The method of claim 11, wherein the detergent contributes 100 ppm to 1100 ppm of metal to the lubricating composition.

13. The method of claim 11, wherein the detergent is a sulphonate detergent.

14. The method of claim 1, further comprising a phosphorus antiwear agent or mixture of phosphorus antiwear agents.

15. The method of claim 1, further comprising a water tolerance agent.

16. The method of claim 1, wherein the lubricating composition is free of zinc dialkyldithiophosphate.

17. The method of claim 1, wherein the oil of lubricating viscosity contains contaminant amounts of water present at 0.1 wt % to 2 wt % of the lubricating composition.

* * * * *